US005954530A

United States Patent [19]

Ichimura

[11] Patent Number: 5,954,530

[45] **Date of Patent: *Sep. 21, 1999**

[54] CONNECTOR FOR CONNECTING CARD TYPE DEVICE

[75] Inventor: Yoshiaki Ichimura, Akiruno, Japan

[73] Assignee: Japan Aviation Electronics Industry, Ltd., Tokyo, Japan

[ * ] Notice: This patent is subject to a terminal disclaimer.

[21] Appl. No.: 08/984,630

[22] Filed: Dec. 3, 1997

[51] Int. Cl.[6] ..... H01R 13/15

[52] U.S. Cl. ..... 439/260; 439/353

[58] Field of Search ..... 439/260, 353

[56] References Cited

U.S. PATENT DOCUMENTS

| | | | |
|---|---|---|---|
| 4,915,648 | 4/1990 | Takase et al. | 439/353 |
| 5,622,505 | 4/1997 | Hashiguchi et al. | 439/260 |

FOREIGN PATENT DOCUMENTS

| | | |
|---|---|---|
| 57-11105 | 3/1982 | Japan . |
| 3-30273 | 2/1991 | Japan . |
| 3-257775 | 11/1991 | Japan . |
| 4-501338 | 3/1992 | Japan . |

*Primary Examiner*—Paula Bradley
*Assistant Examiner*—Antoine Ngandjni
*Attorney, Agent, or Firm*—J. Warren Whitesel; Laff, Whitesel & Saret

[57] ABSTRACT

For connecting a card type device to a counterpart connector, a connector is provided with an elastic film contact held to an inner insulator having a cam portion. The film contact has a first connection end portion and a second connection end portion opposite to the first connection end portion. The first connection end portion is electrically connected to the card type device. The second connection end portion is kept in a free state. A plate-like member has a first member end portion superposed to and fixed to the second connection end portion. A second member end portion of the plate-like member spaces from the elastic film contact and faces the cam portion. The plate-like member operates as a lever to make the second connection end portion be brought into press contact with the counterpart connector in accordance with an operation for connection.

11 Claims, 6 Drawing Sheets

CONNECTOR FOR CONNECTING CARD TYPE DEVICE

BACKGROUND OF THE INVENTION

The present invention relates to a connector for connecting a card type device, such as an IC card or a memory card, or a printed board.

In general, for connecting a flat type flexible cable (hereinafter referred to as "FPC") having a plurality of conductive patterns on the surface of an insulating tape to a counterpart connector disposed on a printed board and having a plurality of contacts arranged in parallel, since the FPC is highly flexible, a fitting connection structure with a reinforcer fixed to a connecting end of the FPC is used as disclosed in, for example, Japanese Second (Examined) Patent Publication (JP-B) No. 57-11105 for "a flexible printed board connector device".

On the other hand, many kinds of connectors for connecting contacts of a board to the contacts of the foregoing counterpart connector using the FPC have been developed. For example, about a mechanical drive type, an electric connector device disclosed in Japanese First (Unexamined) Patent Publication (JP-A) No. 3-30273 or a modified high density back plane connector disclosed in Japanese First (Unexamined) Patent Publication (JP-A) No. 3-257775 may be cited and, about a type using a shape memory alloy, a connector with high density and high signal maintainability disclosed in Japanese First (Unexamined) Patent Publication (JP-A) No. 4-501338 may be cited.

In the former case where the fitting connection structure with the reinforcer fixed to the connecting end of the FPC is used for connecting the FPC to the counterpart connector on the printed board, since the FPC is made of a highly flexible material, the repetition of insertion and release may damage the FPC and, if the conductive patterns are damaged, contact failure may be induced. Accordingly, it is not applicable to a case where the high density contact is aimed using a number of the FPC's.

In the latter case, that is, with respect to the connectors for connecting the contacts of the board to the contacts of the counterpart connector on the printed board using the FPC, there are also various problems. For example, in the mechanical drive type connector disclosed in the foregoing Japanese First Patent Publication (JP-A) No. 3-30273 or No. 3-257775, after the respective portions are fitted to each other, a drive member is moved to connect the contacts with each other. Accordingly, the connector body becomes large in size and complicate in structure so that it is difficult to accomplish the size reduction and the high density. Furthermore, if the number of the contacts is large, an increased operation force is required so that the strength of the drive member and the holding members should be enhanced. On the other hand, in the connector disclosed in the foregoing Japanese First Patent Publication (JP-A) No. 4-501338, there is a merit that a mechanism for operation from the exterior is not necessary so that a mechanical structure is reduced in size. However, since the expensive shape memory alloy is used and thus dedicated heating portion and circuit are required for changing the state of the shape memory alloy, the connector becomes expensive with additional functions other than the essential function as the connector. Further, if the change in temperature is large, there is a possibility that operation failure occurs.

Even if the foregoing connectors are modified for card type electronic device connection, the two-step operation is required, other than insertion and release of the board relative to the counterpart connector, for connecting the contacts with each other, and further, they are not applicable to the high density contact.

SUMMARY OF THE INVENTION

It is therefore an object of the present invention to provide a connector which can eliminate one or more of the foregoing problems and is capable of stably connecting a card type electronic device, such as an IC card, to contacts of a counterpart connector at high density and with low operation force.

It is another object of the present invention to provide a connector which is capable of stably connecting multi-line contacts of a card type electronic device or the like to contacts of a counterpart connector at high density and with low operation force.

Other objects of this invention will become clear as the description proceeds.

According to one aspect of the present invention, there is provided a connector for connecting a card type device to a counterpart connector, comprising an inner insulator having a cam portion and an elastic film contact held to the inner insulator and having a first connection end portion and a second connection end portion opposite to the first connection end portion. The first connection end portion is for electrically connecting the card type device. The second connection end portion is kept in a free state. The connector further comprises a plate-like member having a first member end portion and a second member end portion opposite to the first member end portion. The first member end portion is superposed to and fixed to the second connection end portion. The second member end portion spaces from the elastic film contact and faces the cam portion. The plate-like member operates as a lever to bring said second connection end portion into press contact with the counterpart connector when the first-mentioned connector is connected to the counterpart connector.

According to another aspect of the present invention, there is provided a connector for connecting a card type electronic device to a counterpart connector, comprising an inner insulator provided with a pair of film contacts each including an insulating film having a first end side and a plurality of conductive patterns arranged on a surface of the insulating film, the film contacts fixed to the inner insulator such that backsides of the insulating films confront to each other and orientations of the first end sides of the insulating films coincide with each other, the inner insulator further provided with a pair of plate-like elastic members at the backsides near the first end sides of the insulating films, each of the plate-like elastic members having one end fixed to the first end side of the corresponding insulating film and the other end spacing from the backside of the corresponding insulating film so as to be a free end, and an outer insulator having a receiving recess for receiving therein the inner insulator, with the first end sides of the insulating films along with the fixed ends of the plate-like elastic members confronting the exterior of the outer insulator, wherein the inner insulator is provided at its upper portion with a receiving recess for receiving therein the card type electronic device and at its lower portion with a cam portion, the cam portion arranged between the film contacts and further between the free ends of the plate-like elastic members so as to push the free ends in opposite directions for spacing apart from each other thereby to deform the film contacts in opposite directions to be spaced apart from each other, and wherein, when the card type electronic device is pushed into the receiving recess of the inner insulator, end portions of the conductive patterns of the film contacts at the first end sides are brought into contact with corresponding contacts arranged in parallel on the counterpart connector, while end portions of the conductive patterns of the film contacts at second end sides opposite to the first end sides are brought into contact with corresponding patterns of the card type electronic device.

DESCRIPTION OF THE PREFERRED EMBODIMENT

Figure 1:
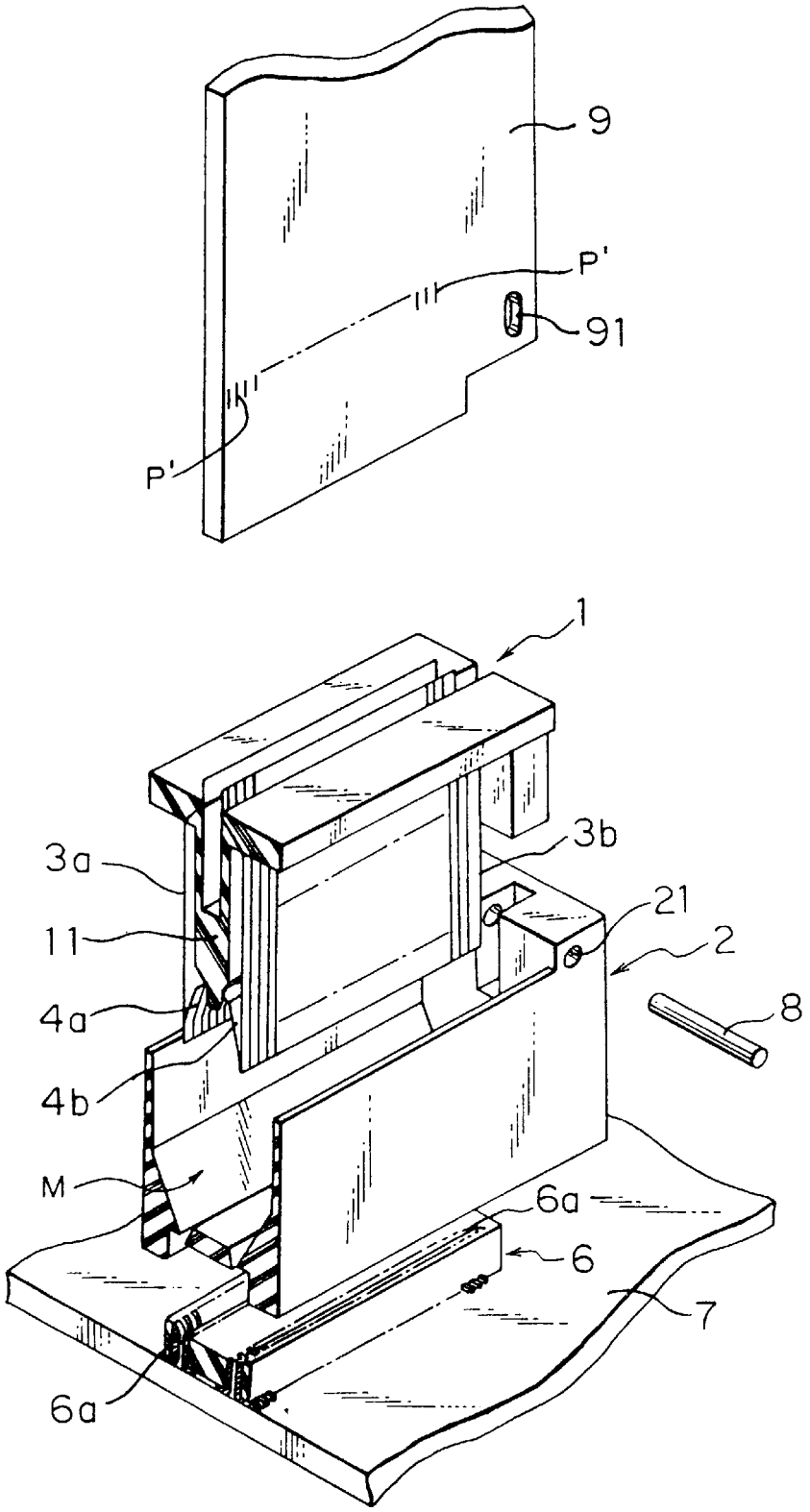
FIG. 1 is an exploded perspective view showing a basic structure of a connector according to a first preferred embodiment of the present invention.
Figure 2:
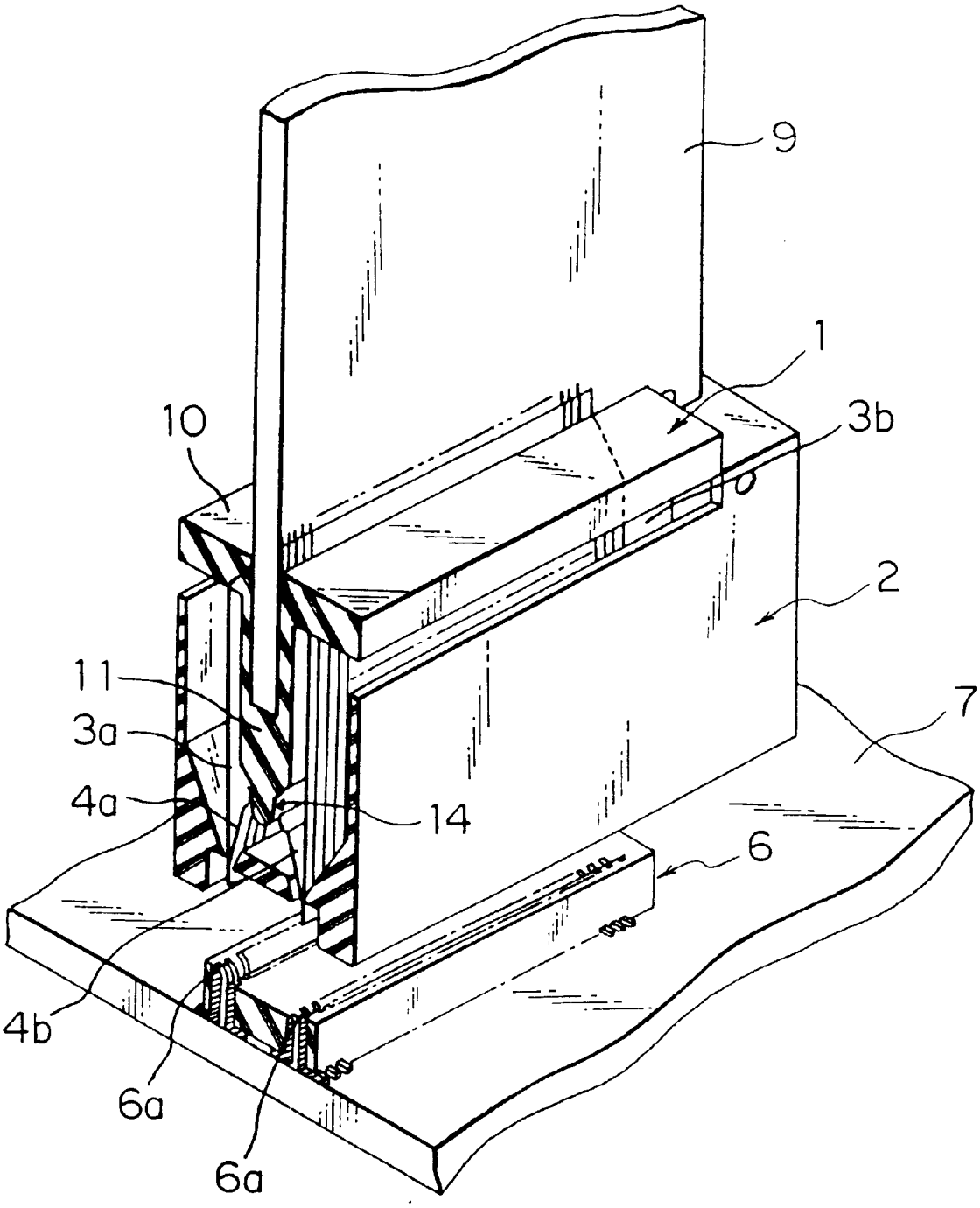
FIG. 2 is a perspective view showing the state of the basic structure of the connector shown in FIG. 1 prior to connection to a counterpart connector.

Referring to FIGS. 1 and 2, description will be made as regards a connector according to a first preferred embodiment of the present invention. The connector is for connecting a card type device 9 such as an IC card to a counterpart connector 6. More particularly, the connector has a structure for connecting a plurality of connecting portions, that is, connecting patterns or pads P', arranged on the card type device 9 relative to two-line contacts 6*a* of the counterpart connector 6 provided on a printed board 7, using a pair of film contacts 3*a* and 3*b*. Specifically, the connector comprises an inner insulator 1 having the film contacts 3*a* and 3*b* fixed at both sides thereof, an outer insulator 2 having a receiving recess M for receiving therein the inner insulator 1, and a pin 8 for limiting displacement of the card type device 9 relative to the outer insulator 2.

The inner insulator 1 includes a top surface portion 10 and a perpendicular portion 11 extending perpendicularly downward from the top surface portion 10. The perpendicular portion 11 is provided at its lower end with a cam portion 14 having symmetrical smooth curved surfaces at both sides thereof. The cam portion 14 includes at its lower end a narrow or rest portion 14*a* having a smaller thickness and a smooth curved surface portion 14*b* extending between a greater thickness or pushing portion 14*c* of the perpendicular portion 11 and the narrow portion 14*a*. Further, at the center of the top surface portion 10 as measured in a width direction thereof, the inner insulator 1 is provided with a card receiving recess 15 extending downward along the center of the perpendicular portion 11.

Each of the film contacts 3*a* and 3*b* comprises an elastic film member of an insulating material and belt-like conductive patterns P arranged on a principal surface of the elastic film member at regular intervals and each extending vertically. Each of the film contacts 3*a* and 3*b* extends in parallel to and spacing from the perpendicular portion 11 of the inner insulator 1 and is held to the top surface portion 10 of the inner insulator 1.

Each of the film contacts 3*a* and 3*b* has an upper end portion and a lower end portion. At the upper end portion, the belt-like conductive patterns P are arranged so as to be connectable with the connecting patterns P' of the card type device 9, respectively. The lower end portion is kept in a free state. The upper and the lower end portions of each of the film contacts 3*a* and 3*b* are referred to as a first and a second connection end portion, respectively.

To the lower end portion of each of the film contacts 3*a* and 3*b* is superposed and fixed a lower end portion of corresponding one of plate-like elastic members 4*a* and 4*b* whose upper ends or tips face or abut the narrow portion 14*a* of the cam portion 14 during non-connection relative to the counterpart connector 6. It is to be noted that the upper ends of the plate-like elastic members 4*a* and 4*b* spaces from the film contacts 3*a* and 3*b*. The lower end portion of each of the plate-like elastic members 4*a* and 4*b* is referred to as a first member end portion. Each of the upper ends of the plate-like elastic members 4*a* and 4*b* is referred to as a second member end portion.

In this embodiment, each of the plate-like elastic members 4*a* and 4*b* is made of an insulating material. However, when the film contact is the microstrip line with the film surface being the ground, it is advantageous to form the plate-like elastic members 4*a* and 4*b* of metal in view of the mechanical characteristic. Materials may be selected depending on necessity.

Figure 3:
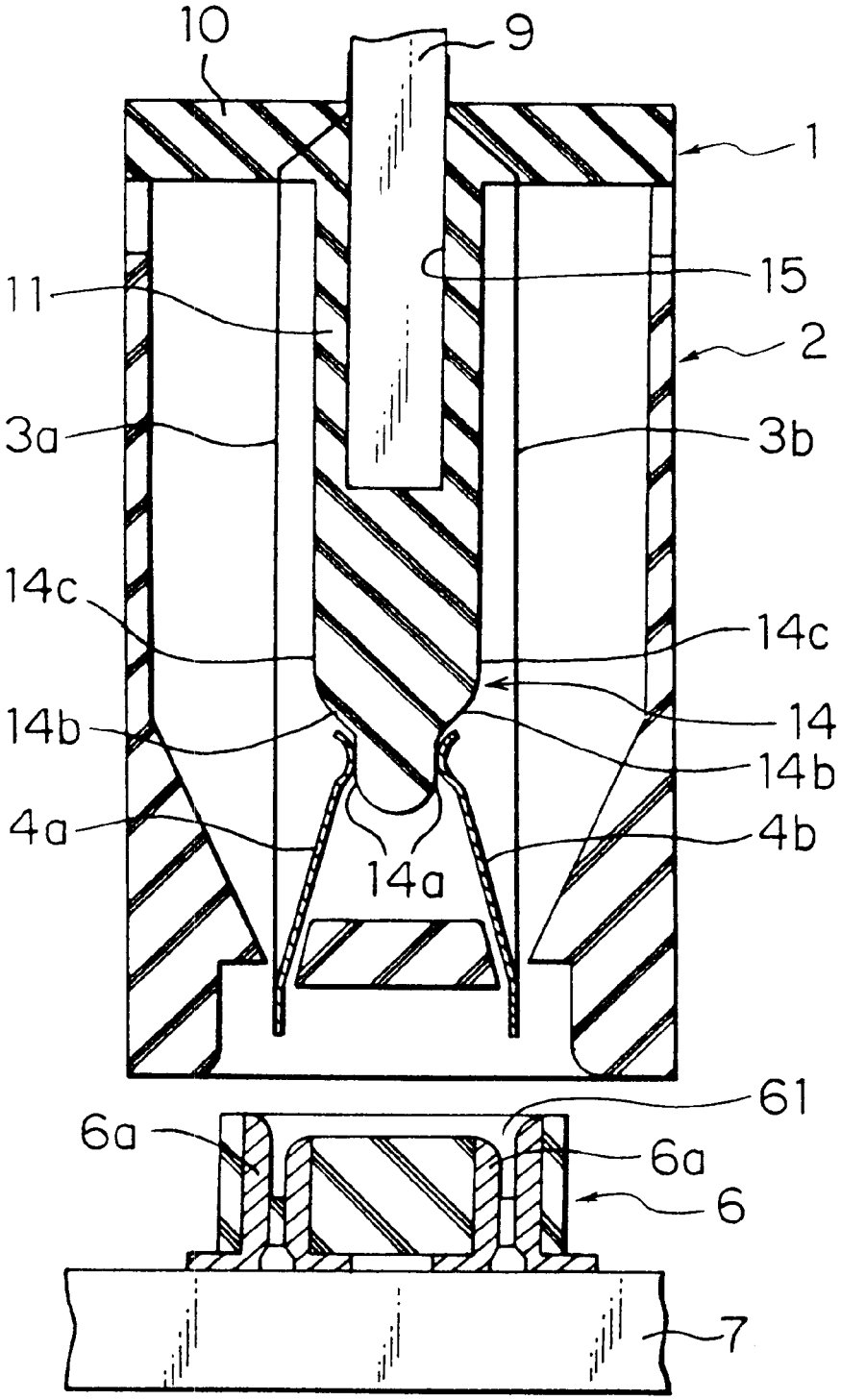
FIG. 3 is a front sectional view of FIG. 2.

As shown in FIG. 3 in addition to FIG. 2, during non-connection relative to the counterpart connector 6, each of the film contacts 3*a* and 3*b* is retained by the inner insulator 1 so as to extend straight vertically. In this state, the fixed portions between the film contacts 3*a* and 3*b* and the plate-like elastic members 4*a* and 4*b* can be inserted into receiving recesses 61 of the counterpart connector 6 unresistedly. Specifically, a width of each of the receiving recesses 61 of the counterpart connector 6 is set greater than the sum of thicknesses of the film contacts 3*a* and 3*b* and the plate-like elastic member 4*a* and 4*b*.

When the card type device 9 is loaded into the card receiving recess 15 of the inner insulator 1 which is received in the outer insulator 2, the film contacts 3*a* and 3*b* are connected with the connecting patterns P' of the card type device 9.

The card type device 9 is formed with a vertically elongate hole 91 at its lower and lateral end portion. On the other hand, the outer insulator 2 is formed with pin insertion holes 21 at corresponding positions thereof. After matching the elongate hole 91 and the pin insertion holes 21, the pin 8 is inserted therethrough to prevent the card type device 9 from coming off relative to the outer insulator 2. In this state, the card type device 9 is vertically movable by a distance corresponding to a difference between a vertical length of the elongate hole 91 and a diameter of the pin 8.

Now, the description will be made as regards the connection to the counterpart connector 6.

From the state shown in FIGS. 2 and 3, the card type device 9 is pushed downward. Then, the lower ends of the film contacts 3*a* and 3*b* abut the bottoms of the receiving recesses 61 of the counterpart connector 6, respectively. When the card type device 9 is further pushed downward, the film contacts 3*a* and 3*b* start to be buckled. At this time, as the free ends (upper ends) of the plate-like elastic members 4*a* and 4*b* are raised from the narrow portion 14*a* through the curved surface portion 14*b* to the greater thickness portion 14*c*, the film contacts 3*a* and 3*b* are inclined in directions to be buckled outward, respectively, and, due to the lever motion, the lower ends of the film contacts 3*a* and 3*b* move in inward narrowing directions, respectively. As a result, as shown in FIG. 4, the lower ends of the film contacts 3*a* and 3*b* are brought into pressure contact with the contacts 6*a* within the receiving recesses 61 of the counterpart connector 6, respectively.

Figure 4:
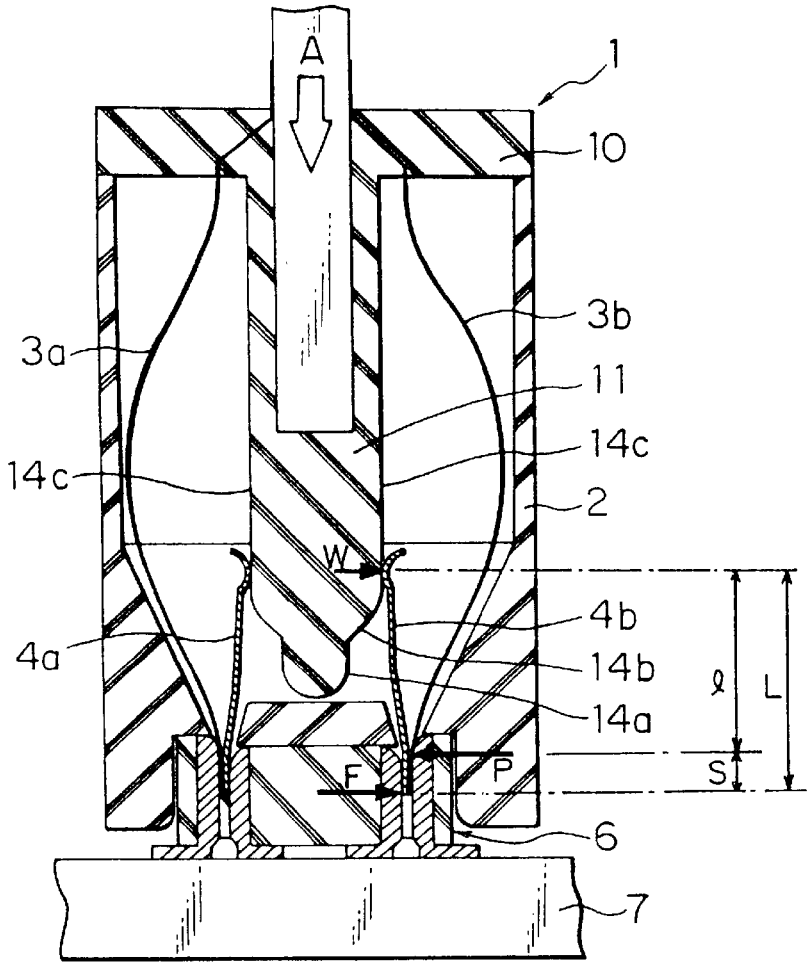
FIG. 4 is a front sectional view showing the state of the basic structure of the connector shown in FIG. 1 being connected to the counterpart connector.

In the contact state of the film contacts 3*a* and 3*b* relative to the contacts 6*a* of the counterpart connector 6 as shown in FIG. 4, when a force is applied to the upper end of each of the plate-like elastic members 4*a* and 4*b*, the relation of contact forces at the fitted portion becomes W=(S/L)P, W=(S/l)F (where the flexural rigidity of the film contacts 3*a* and 3*b* is ignored) due to the principle of lever. Accordingly, by setting S to be smaller relative to l and L, W can be reduced. When W is small, a pushing force for the card type device 9 can be small and an operation force upon connection can be small.

Figure 5:
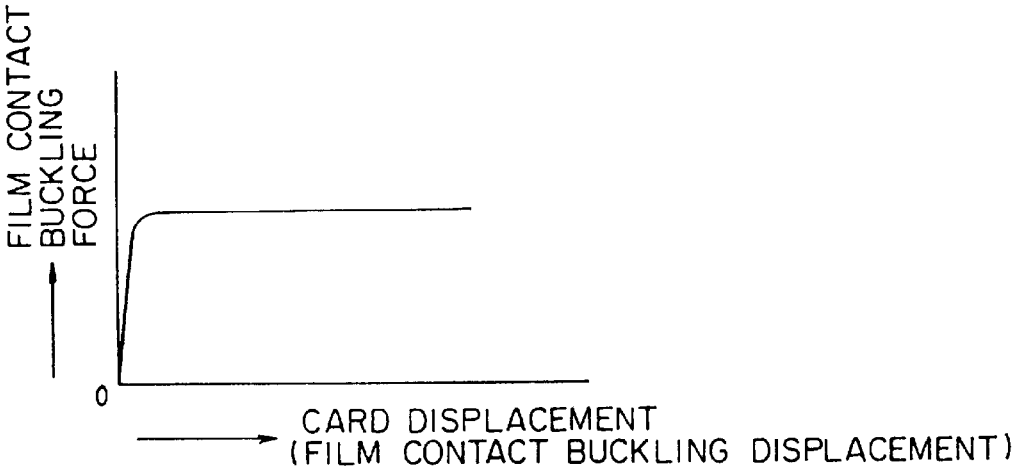
FIG. 5 is a graph showing a relationship between film contact buckling force and film contact buckling displacement.

As shown in FIG. 5, a force required for buckling the film contact 3*a*, 3*b* is constant regardless of a displacement of the card type device 9 and can be set smaller by reducing a thickness of each of the film contacts 3*a* and 3*b*. The force required for the buckling (hereinafter referred to as A) is applied to the card type device 9 as a pushing-back force while the connector engages with the counterpart connector 6. On the other hand, between the plate-like elastic member 4*a*, 4*b* and the cam portion 14, a frictional resistance (hereinafter referred to as B) is generated due to the force W. If B>A, the card type device 9 is not forced back. On the other hand, if B<A, the card type device 9 requires a force resisting A-B so that a fixing structure for the card type device 9 is necessary.

According to the connector, a required contact force can be achieved with a small force by means of the lever type plate-like elastic member. Further, the fitting connection of the connector relative to the counterpart connector can be carried out with an operation force overcoming a small buckling resistance of the film contact.

Since the film contact is used, the high-density arrangement can be easily achieved. Further, by arranging the backside of the film contact to be the ground surface, the microstrip line is achieved so that the connector with a high-speed transmission characteristic can be accomplished.

Figure 6:
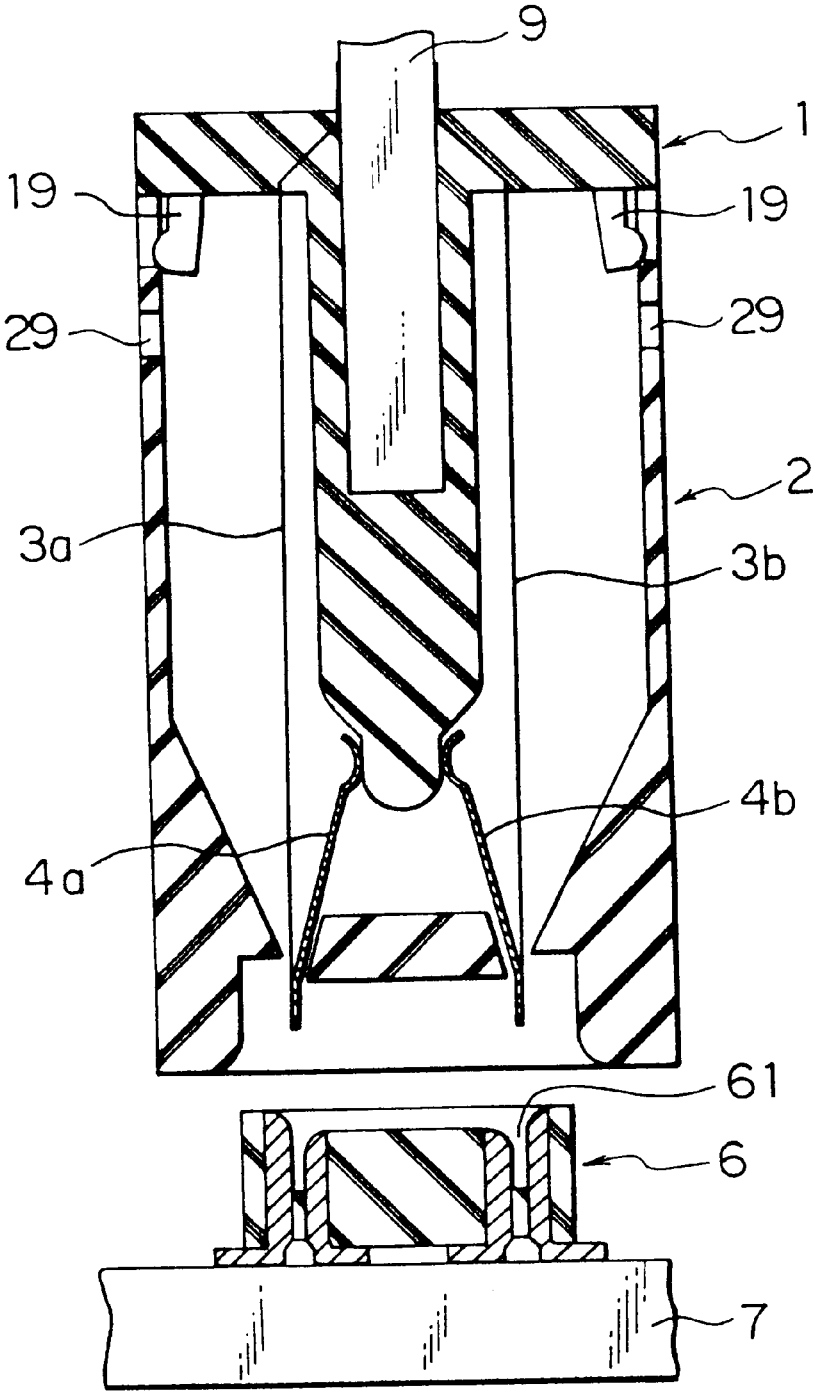
FIG. 6 is a front sectional view showing the state of a basic structure of a card type electronic device connecting connector prior to connection to a counterpart connector.
Figure 7:
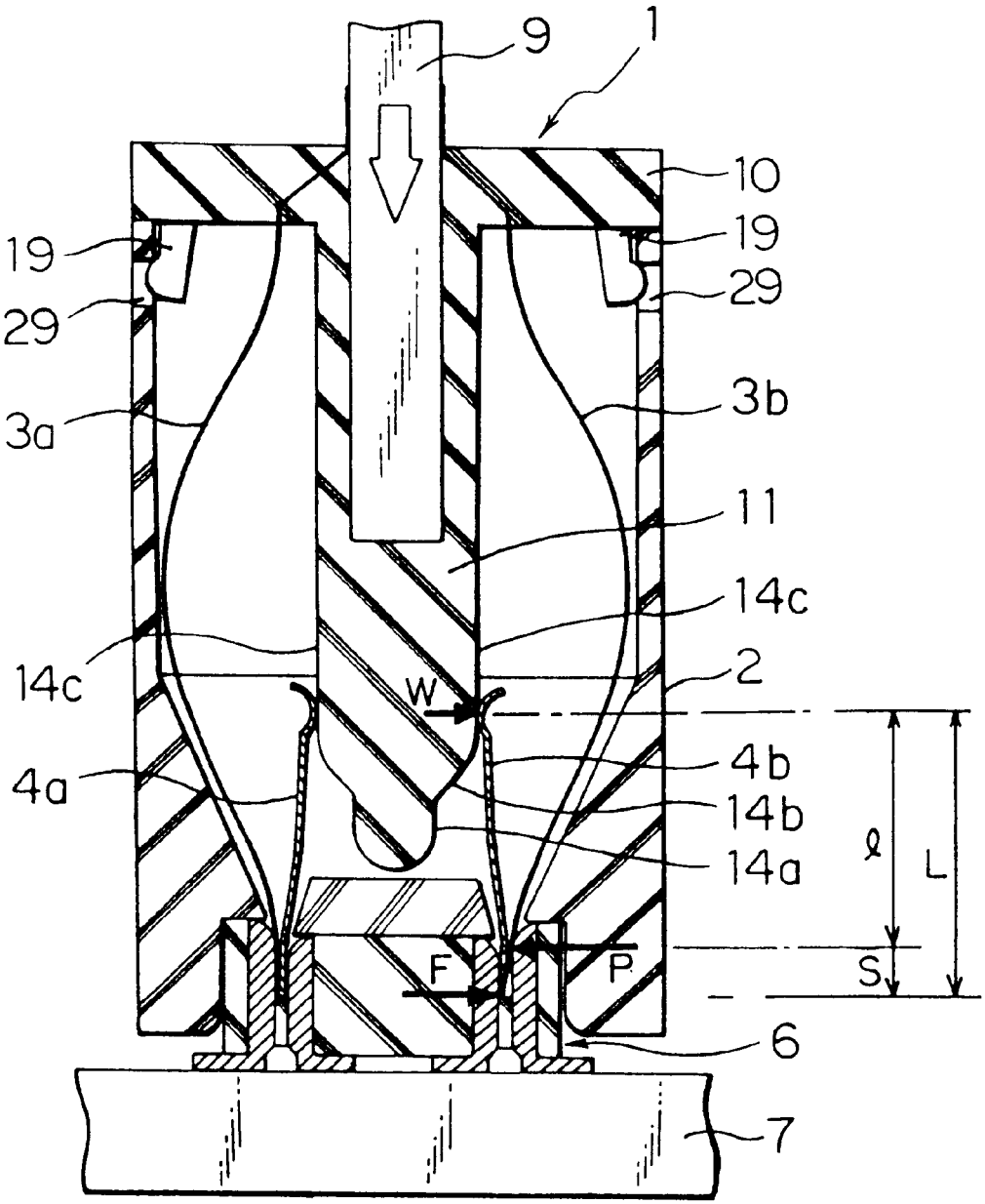
FIG. 7 is a front sectional view showing the state of the basic structure of the connector shown in FIG. 6 being connected to the counterpart connector.

Referring to FIGS. 6 and 7, the description will be made as regards a connector according to a second preferred embodiment of the present invention. Similar parts are designated by like reference numerals.

The connector of FIGS. 6 and 7 further comprises hooks 19 provided on the inner insulator 1. The outer insulator 2 is provided with corresponding engaging windows 29 for engaging with the hooks 19, respectively. Assuming that a resistance of the hook 19 relative to the outer insulator 2 in the engaging state is C, B+C>A is established in this embodiment. A combination of the hooks 19 and the engaging windows 29 will be referred to as a coupling arrangement for coupling the inner and the outer insulators 1 and 2 to each other to keep the particular relative position. A combination of the coupling arrangement and the inner and the outer insulators 1 and 2 will be referred to as a keeping means for keeping the cam portion 14 and the upper end portions of the plate-like elastic members 4*a* and 4*b* to have a particular relative position where the plate-like elastic members 4*a* and 4*b* make the lower end portions of the film contacts 3*a* and 3*b* be electrically connected to the counterpart connector 6 with an elastic bending of each of the film contact 3*a* and 3*b*.

While the present invention has been described in terms of the preferred embodiments, the invention is not to be limited thereto, but can be embodied in various ways without departing from the principle of the invention as defined in the appended claims. For example, the card type device may be a memory card or the like, a small printed board having connecting terminals on the surface of the board or the like.

What is claimed is:

1. A connector for connecting a card type device to a counterpart connector, comprising:

an inner insulator having a cam portion;

an elastic film contact held to said inner insulator and having a first connection end portion and a second connection end portion opposite to said first connection end portion, said first connection end portion being for electrically connecting said card type device, said second connection end portion being kept in a free state; and a plate-like member having a first member end portion and a second member end portion opposite to said first member end portion, said first member end portion being superposed to and fixed to said second connection end portion, said second member end portion spacing from said elastic film contact and facing said cam portion, said plate-like member operating as a lever to make said second connection end portion be brought into press contact with said counterpart connector when the first-mentioned connector is connected to said counterpart connector.

2. A connector as claimed in claim 1, further comprising an outer insulator having a receiving recess for receiving said cam portion therein, said inner insulator having a receiving recess for receiving said card type device therein, said outer insulator having a pin insertion hole, said card type device having an elongated hole, said connector further comprising a pin inserted into said pin insertion and said elongated holes.

3. A connector as claimed in claim 1, further comprising keeping means connected to said inner insulator and associated with said counterpart connector for keeping said cam portion and said second member end portion to have particular relative position where said plate-like member makes said second connection end portion be electrically connected to said counterpart connector with an elastic bending of said elastic film contact.

4. A connector as claimed in claim 3, wherein said keeping means comprises:

an outer insulator having a receiving recess for receiving therein said cam portion, said outer insulator being engaged with said counterpart connector when said connector is connected to said counterpart connector; and coupling means for coupling said inner and said outer insulators to each other to keep said particular relative position.

5. A connector as claimed in claim 4, wherein one of said inner and said outer insulators has a hook, another of said inner and said outer insulators having corresponding engaging window for engaging with said hook to keep said particular relative position.

6. A connector as claimed in claim 1, wherein said film contact comprises:

an insulating film having a principal surface; and a plurality of conductive patterns arranged on said principal surface of the insulating film.

7. A connector as claimed in claim 1, wherein said plate-like member has an elasticity.

8. A connector as claimed in claim 1, wherein said cam portion comprises:

a rest portion for resting said second member end portion; and a pushing portion for pushing said second member end portion towards said elastic film contact in said particular relative position.

9. A connector as claimed in claim 8, wherein said cam portion further comprises a curved surface between said rest portion and said pushing portion.

10. A connector for connecting a card type electronic device to a counterpart connector, comprising:

an inner insulator provided with a pair of film contacts each including an insulating film having a first end side and a plurality of conductive patterns arranged on a surface of the insulating film, said film contacts fixed to the inner insulator such that backsides of the insulating films confront to each other and orientations of said first end sides of the insulating films coincide with each other, said inner insulator further provided with a pair of plate-like elastic members at said backsides near said first end sides of the insulating films, each of said plate-like elastic members having one end fixed to the first end side of the corresponding insulating film and the other end spacing from the backside of the corresponding insulating film so as to be a free end; and an outer insulator having a receiving recess for receiving therein said inner insulator, with said first end sides of the insulating films along with said fixed ends of the plate-like elastic members confronting the exterior of the outer insulator;

wherein said inner insulator is provided at its upper portion with a receiving recess for receiving therein the card type electronic device and at its lower portion with a cam portion, said cam portion arranged between said film contacts and further between said free ends of the plate-like elastic members so as to push said free ends in opposite directions for spacing apart from each other thereby to deform said film contacts in opposite directions to be spaced apart from each other, and wherein, when the card type electronic device is pushed into said receiving recess of the inner insulator, end portions of the conductive patterns of said film contacts at said first end sides are brought into contact with corresponding contacts arranged in parallel on the counterpart connector, while end portions of the conductive patterns of said film contacts at second end sides opposite to said first end sides are brought into contact with corresponding patterns of the card type electronic device.

11. A connector as claimed in claim 10, wherein said inner and outer insulators are provided with a hook mechanism for engagement therebetween while said film contacts are in contact with the counterpart connector.

* * * * *

UNITED STATES PATENT AND TRADEMARK OFFICE

CERTIFICATE OF CORRECTION

PATENT NO. : 5,954,530
DATED : September 21, 1999
INVENTOR(S) : Yoshiaki Ichimura It is certified that error appears in the above-identified patent and that said Letters Patent is hereby corrected as shown below:

Title page,
Insert -- Foreign Application Priority Data
May 30, 1995 [JP] Japan 132011/1995 --;

Column 1,
Line 49: Replace "complicate" and insert -- complicated --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*